US009300116B2

(12) United States Patent
Farrell et al.

(10) Patent No.: US 9,300,116 B2
(45) **Date of Patent: *Mar. 29, 2016**

(54) SPARK PLUG

(71) Applicant: Nano Spark Inc., Toronto (CA)

(72) Inventors: Mark Farrell, Norval (CA); Richard Farrell, Norval (CA); Harry E. Ruda, Toronto (CA)

(73) Assignee: Nano Spark Inc., Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/628,621

(22) Filed: Feb. 23, 2015

(65) Prior Publication Data

US 2015/0171599 A1 Jun. 18, 2015

Related U.S. Application Data

(63) Continuation of application No. 14/462,184, filed on Aug. 18, 2014, now Pat. No. 9,088,137, which is a continuation-in-part of application No. 14/233,522, filed as application No. PCT/CA2011/001184 on Oct. 24, 2011, now Pat. No. 9,112,334.

(60) Provisional application No. 61/509,270, filed on Jul. 19, 2011.

(51) Int. Cl.

| | |
|---|---|
| ***H01T 13/32*** | (2006.01) |
| ***H01T 13/20*** | (2006.01) |
| ***H01T 13/26*** | (2006.01) |
| ***H01T 13/46*** | (2006.01) |

(Continued)

(52) U.S. Cl.

CPC ..... *H01T 13/20* (2013.01); *H01T 13/04* (2013.01); *H01T 13/26* (2013.01); *H01T 13/32* (2013.01); *H01T 13/467* (2013.01); *H01T 21/06* (2013.01)

(58) Field of Classification Search

CPC ..... H01T 13/20; H01T 13/56; H01T 13/467

See application file for complete search history.

(56) References Cited

U.S. PATENT DOCUMENTS

| | | | |
|---|---|---|---|
| 5,731,654 | A | 3/1998 | Benedikt et al. |
| 2009/0140623 | A1 | 6/2009 | Ugalde |

(Continued)

FOREIGN PATENT DOCUMENTS

| | | | |
|---|---|---|---|
| EP | 0069993 | A1 | 1/1983 |

OTHER PUBLICATIONS

International Search Report and Written Opinion for PCT/CA2011/001184, dated Mar. 7, 2012.

(Continued)

*Primary Examiner* — Mariceli Santiago

(74) *Attorney, Agent, or Firm* — Dinsmore & Shohl LLP; Allen M. Krass

(57) ABSTRACT

The plug comprises a nut, a coupling extending from the nut and adapted to receive an ignition wire and an insulator extending from the nut and away from the coupling. A positive electrode extends through the insulator. An externally-threaded tubular portion extends from the nut in surrounding relation to the insulator and terminating, short of the insulator end, in a cap that is disposed in spaced relation to the insulator. The cap defines a void having: a central portion into which the positive electrode extends; an annular channel surrounding the central portion; and a plurality of lobes, each positioned with respect to the central portion as the planet gears are positioned with respect to the sun gear in a planetary gear. The cap has a central surface that is axially spaced from the insulator and a convex surface that surrounds and extends to the central surface.

5 Claims, 4 Drawing Sheets

(51) Int. Cl.
*H01T 21/06* (2006.01)
*H01T 13/04* (2006.01)

(56) References Cited

U.S. PATENT DOCUMENTS

2009/0241321 A1 10/2009 Farrell et al.
2010/0133976 A1 6/2010 Siegel
2011/0025186 A1 2/2011 Kunitomo et al.
2011/0071874 A1 3/2011 Schneersohn et al.

OTHER PUBLICATIONS

Extended European Search Report CTM Application No. 11869542.8-1801 / 2735065 PCT/CA2011001184 dated Oct. 22, 2014.

SPARK PLUG

CROSS-REFERENCE TO RELATED APPLICATIONS

This application is a continuation of U.S. patent application Ser. No. 14/462,184 filed Aug. 18, 2014, which is a continuation-in-part of U.S. patent application Ser. No. 14/233,522, filed Apr. 28, 2014, which is national stage entry application of PCT/CA2011/001184, filed Oct. 24, 2011, which claims priority of U.S. Provisional Application No. 61/509,270, filed Jul. 19, 2011, all of which are incorporated herein in their entirety by reference.

FIELD OF THE INVENTION

The present invention relates to spark-ignited internal combustion engines.

BACKGROUND OF THE INVENTION

In internal combustion engines, it is conventional to initiate combustion with the use of spark plugs. In conventional spark plugs, a body which defines a longitudinal axis is provided. The body has, adjacent one end thereof, a metal ring which is orientated coaxially with the longitudinal axis. The body further includes a metal tube which: is orientated coaxially with the longitudinal axis; extends from the ring towards the other end of the body; and is externally-threaded for engagement in a corresponding threaded bore in an engine block in use. A porcelain insulator also forms part of the body. The insulator has a portion disposed inside the tube. This portion extends axially, from inside the tube, beyond the ring, and has an elongate void extending axially therethrough. An elongate positive electrode occupies the void and extends axially beyond the insulator to a terminus which defines the one end of the body. Conventional spark plugs also include an electrode leg. The electrode leg has two arms transversely connected to one another, with one arm extending axially from the ring and beyond the electrode and the other arm extending radially inwardly from the one arm so as to terminate in an end portion that is axially-spaced from the terminus. The spark gap in this conventional plug is the space defined between the positive electrode and the electrode leg.

SUMMARY OF THE INVENTION

A spark plug forms one aspect of the invention. The plug, which is for use with an engine block/cylinder head having a threaded bore and is also for use with a spark plug wrench and an ignition wire, comprises a nut portion, a coupling portion, an insulator portion, a positive electrode and a ground electrode. The nut portion is adapted to be turned by the wrench. The coupling portion extends from the nut portion and is adapted to receive the ignition wire. The insulator portion extends from the nut portion and away from the coupling portion to an end. The positive electrode extends through and beyond the end of the insulator portion. The ground electrode includes a tubular metal portion and a cap portion to which the tubular portion extends. The tubular metal portion: extends from the nut portion in circumferentially surrounding relation to the insulator portion; terminates such that a portion of the insulator portion extends beyond the tubular metal portion; is orientated coaxially about and defines a longitudinal axis; and is externally-threaded for engagement in the threaded bore in said engine block in use. The cap portion is disposed in spaced relation to the insulator portion and defines a void having: a central portion into which the positive electrode extends; an annular channel surrounding the central portion; and a plurality of lobes, each being positioned with respect to the central portion in a manner analogous to the placement of the planet gears with respect to the sun gear in a planetary gear. The cap also has a central surface that is axially spaced from that portion of the insulator that protrudes beyond the tubular metal portion; and a convex surface that surrounds and extends to the central surface.

According to another aspect of the invention, the central surface can be orientated substantially normally to the longitudinal axis and substantially coplanar with the end of the positive electrode.

According to another aspect of the invention, the plurality of lobes can consist of three to seven lobes.

According to another aspect of the invention, if

R1 is the radius of each planet gear

R2 is the distance from the axis of each planet gear to the axis of the sun gear R3 is the outer radius of the ground electrode R4 is the outer radius of the annular channel then R1:R2:R3:R4:R5 can be about 0.12:0.305:0.475:0.25

According to another aspect of the invention, the plurality of lobes can consist of seven lobes.

According to another aspect of the invention, the cap portion can have radially inwardly disposed fingers which separate the lobes from one another, each finger having a terminus to which said each finger extends, the thickness of the finger at the terminus as measured in the longitudinal direction being substantially equal to the length of that portion of the positive electrode that extends beyond the insulation.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

DETAILED DESCRIPTION OF THE EXEMPLARY EMBODIMENT

Figure 1:
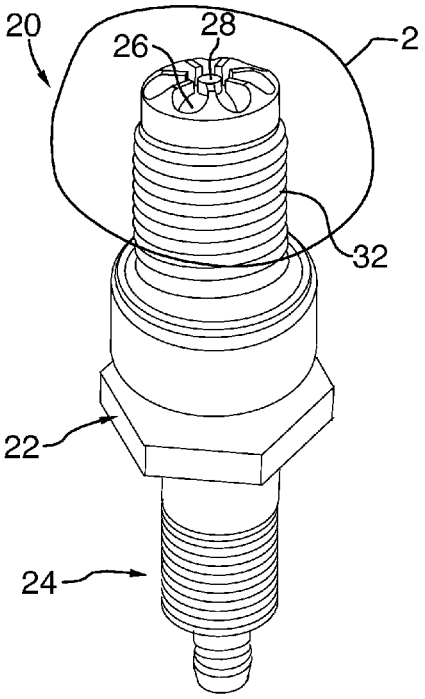
FIG. 1 is a perspective view of a spark plug according to an exemplary embodiment of the invention
Figure 2:
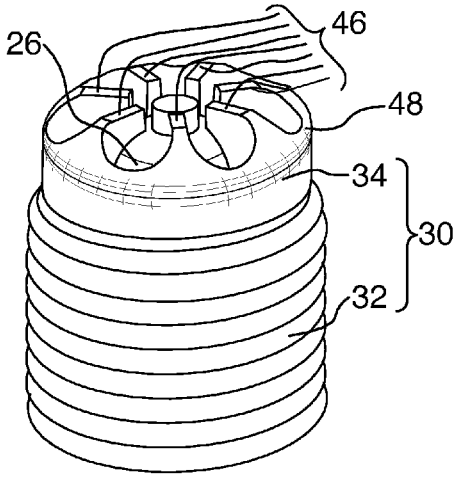
FIG. 2 is an enlarged view of encircled area 2 of FIG. 1
Figure 3:
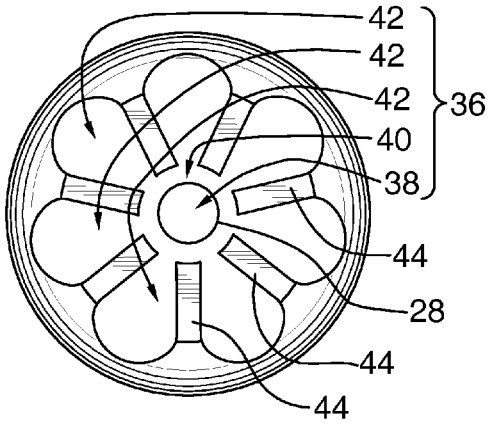
FIG. 3 is an end view of the structure of FIG. 1.
Figure 4:
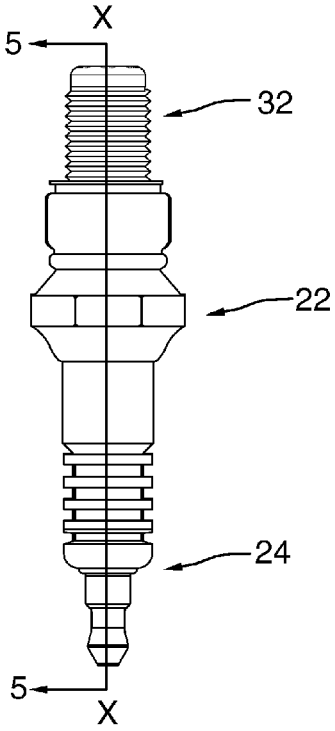
FIG. 4 is a side view of the structure of FIG. 1.
Figure 5:
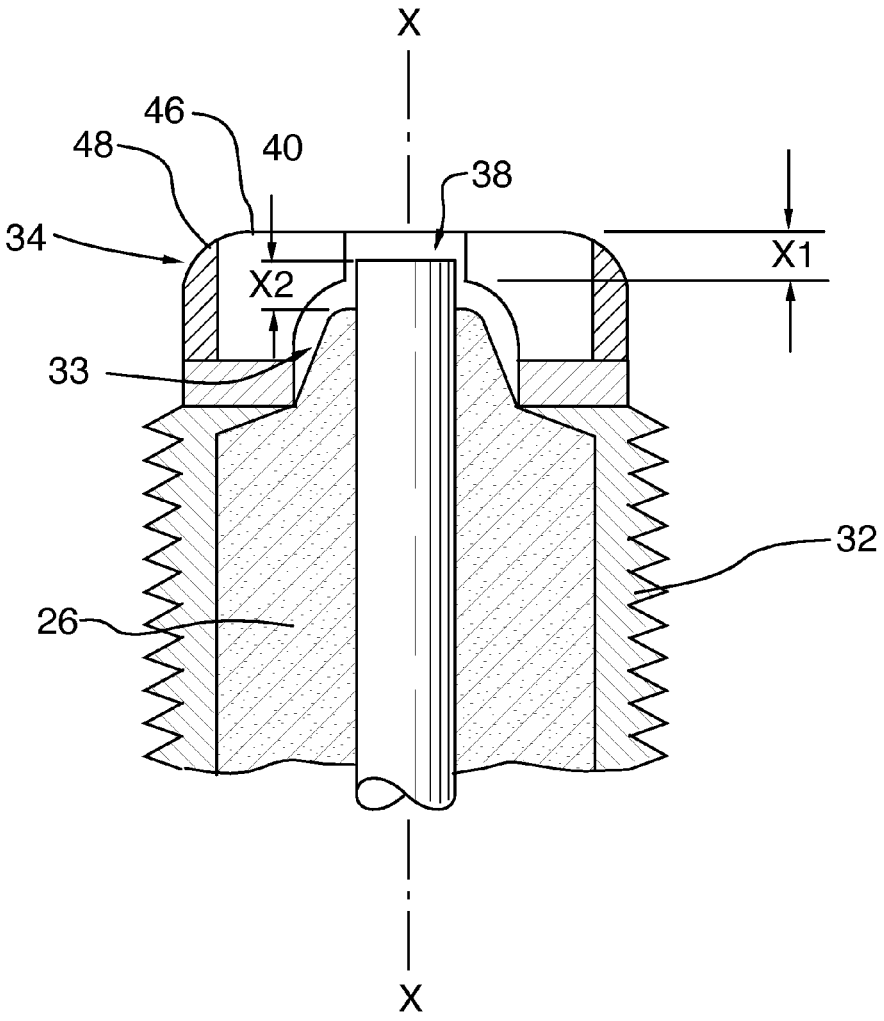
FIG. 5 is a view along 5-5 of FIG. 4.

As an initial matter, the spark plug 20 according to the exemplary embodiment shown in FIGS. 1-4 is for use with an engine block/cylinder head having a threaded bore and also for use with a spark plug wrench and an ignition wire, all as is conventional.

The plug 20 also comprises, as is conventional, a nut portion 22, a coupling portion 24, an insulator portion 26, a positive electrode 28 and a ground electrode 30.

As is conventional: the nut portion 22 is adapted to be turned by the wrench; the coupling portion 24 extends from the nut portion 22 and is adapted to receive the ignition wire; the insulator portion 26 extends from the nut portion 22 and away from the coupling portion 24 to an end; the positive electrode 28 extends through and beyond the end of the insulator portion 26. Also as is conventional, the ground electrode 30 includes a tubular metal portion 32 which: extends from the nut portion 22 in surrounding relation to the insulator portion 26; terminates such that a portion 33 of the insulator portion 26 extends beyond the tubular metal portion 32; is orientated coaxially about and defines a longitudinal axis X-X and is externally-threaded for engagement in the threaded bore in said engine block in use.

However, in this spark plug, there is provided a cap portion 34 to which the tubular portion 32 extends and is circumferentially connected.

The cap portion 34:

is disposed in spaced relation to the insulator 26 and defines a void 36 having: a central portion 38 into which the positive electrode 28 extends; an annular channel 40 surrounding central portion 38; and a plurality of lobes 42, each being positioned with respect to the central portion 38 in a manner analogous to the placement of the planet gears with respect to the sun gear in a planetary gear.

has a plurality of radially inwardly disposed fingers 44 which separate the lobes 42 from one another, each finger 44 having a terminus to which said each finger extends, the thickness X1 of the finger at the terminus as measured in the longitudinal direction being substantially equal to the length X2 of that portion of the positive electrode that extends beyond the insulation has: (i) a central surface 46 that is axially spaced from that portion of the insulator 26 that protrudes beyond the tubular portion 32 and is orientated substantially normally to the longitudinal axis X-X and substantially coplanar with the end of the positive electrode 28; and (ii) a convex surface 48 that surrounds and extends from the tubular metal portion 32 to the central surface 46.

The geometry of the cap portion is such that if R1 is the radius of each planet gear, R2 is the distance from the axis of each planet gear to the axis of the sun gear, R3 is the outer radius of the ground electrode and R4 is the outer radius of the annular channel, then R1:R2:R3:R4:R5 is about 0.12:0.305:0.475:0.25

The spark plug of the exemplary embodiment has proven to be of substantial advantage in numerous tests that have been carried out.

TABLE 1

| Autolite AR3932X | | | modified AR3932X | | | Gains: Gain In | |
|---|---|---|---|---|---|---|---|
| RPM | Torque. Lb/FT | HP | RPM | Torque. Lb/FT | HP | Torque Lb/Ft | Gain In HP |
| 5500 | 444.4 | 502.1 | 5500 | 448.3 | 506.2 | +3.9 | +4.1 |
| 5600 | 448.8 | 516.4 | 5600 | 453.8 | 521.9 | +5.0 | +5.5 |
| 5700 | 450.2 | 527.3 | 5700 | 455.3 | 532.9 | +5.1 | +5.6 |
| 5800 | 451.1 | 537.9 | 5800 | 456.8 | 544.3 | +5.7 | +6.1 |
| 5900 | 451.8 | 548.0 | 5900 | 457.7 | 554.8 | +5.9 | +6.8 |
| 6000 | 451.8 | 557.5 | 6000 | 457.3 | 563.9 | +5.5 | +6.4 |
| 6100 | 450.8 | 565.5 | 6100 | 457.2 | 573.2 | +6.4 | +7.7 |
| 6200 | 449.9 | 573.9 | 6200 | 456.8 | 582.3 | +6.9 | +8.4 |
| 6300 | 449.2 | 582.3 | 6300 | 455.7 | 590.3 | +6.5 | +8.0 |
| 6400 | 448.1 | 590.4 | 6400 | 453.7 | 597.4 | +5.6 | +7.0 |

TABLE 1-continued

| Autolite AR3932X | | | modified AR3932X | | | Gains: Gain In | |
|---|---|---|---|---|---|---|---|
| RPM | Torque. Lb/FT | HP | RPM | Torque. Lb/FT | HP | Torque Lb/Ft | Gain In HP |
| 6500 | 446.3 | 597.3 | 6500 | 451.7 | 604.1 | +5.4 | +6.8 |
| 6600 | 444.1 | 603.8 | 6600 | 448.7 | 609.7 | +4.6 | +5.9 |
| 6700 | 441.6 | 609.6 | 6700 | 444.3 | 613.0 | +2.7 | +3.4 |
| 6800 | 438.4 | 614.5 | 6800 | 440.7 | 617.4 | +2.3 | +2.9 |
| 6900 | 435.8 | 619.9 | 6900 | 437.5 | 622.0 | +1.7 | +2.1 |
| 7000 | 432.0 | 623.9 | 7000 | 434.0 | 626.4 | +2.0 | +2.5 |
| 7100 | 427.6 | 626.4 | 7100 | 430.5 | 630.3 | +2.9 | +3.9 |
| 7200 | 423.1 | 629.0 | 7200 | 425.9 | 632.8 | +2.8 | +3.8 |
| 7300 | 418.5 | 631.0 | 7300 | 421.1 | 634.5 | +2.6 | +3.5 |
| 7400 | 412.9 | 631.6 | 7400 | 415.4 | 635.0 | +2.5 | +3.4 |
| 7500 | 406.5 | 630.4 | 7500 | 408.9 | 633.7 | +2.4 | +3.3 |
| 7600 | 399.5 | 628.3 | 7600 | 402.5 | 632.7 | +3.0 | +4.4 |
| 7700 | 392.4 | 625.5 | 7700 | 395.6 | 630.2 | +3.2 | +4.7 |
| 7800 | 385.7 | 623.4 | 7800 | 389.3 | 628.8 | +3.6 | +5.4 |
| 7900 | 379.2 | 621.0 | 7900 | 383.8 | 628.0 | +4.6 | +7.0 |
| 8000 | 372.0 | 617.6 | 8000 | 377.2 | 625.8 | +5.2 | +8.2 |

Table 1 shows dynamometer tests carried out using a CRA Super Series Template 360 Chev Racing Engine with a 9:1 compression. Timing was set at 34. The carburetor used was a Holly 390 with 77 jets. Oil used was 15/40 viscosity. Fuel octane: 110. Load factor was set at 1.21. The left columns show developed torque and HP at RPM values between 5500 and 8000 using a set of new, standard Autolite AR3932X plugs. The middle columns shows the same data set for the same plugs, modified with the inventive cap portion. The right columns shown the torque and horsepower gains, which manifest at all measured speeds.

TABLE 2

| OE Autolite AR473 | | | Modified AR4723 | | | Gain | |
|---|---|---|---|---|---|---|---|
| RPM | Torque. Lb/FT | HP | RPM | Torque. Lb/FT | HP | Gain In Torque | Gain In HP |
| 4500 | 428.7 | 391.1 | 4500 | 447.5 | 401.6 | +18.8 | +10.5 |
| 4600 | 435.2 | 406 | 4600 | 449.6 | 412.6 | +14.4 | +6.6 |
| 4700 | 436 | 415.6 | 4700 | 449.8 | 421.7 | +13.8 | +6.1 |
| 4800 | 437 | 425.5 | 4800 | 450.6 | 431.6 | +13.6 | +6.1 |
| 4900 | 437.9 | 435.3 | 4900 | 450.6 | 440.6 | +12.7 | +5.3 |
| 5000 | 437.8 | 444.3 | 5000 | 451.3 | 450.4 | +13.5 | +6.1 |
| 5100 | 437.2 | 452.5 | 5100 | 450.2 | 458.3 | +13 | +5.8 |
| 5200 | 436 | 460.3 | 5200 | 448.5 | 465.7 | +12.5 | +5.4 |
| 5300 | 434.9 | 468 | 5300 | 445.5 | 471.5 | +10.6 | +3.5 |
| 5400 | 432.9 | 474.9 | 5400 | 442.7 | 477.5 | +9.8 | +2.9 |
| 5500 | 429.5 | 479.9 | 5500 | 439.8 | 483.2 | +10.3 | +3.3 |
| 5600 | 425.8 | 484.7 | 5600 | 437.1 | 489.2 | +11.3 | +4.5 |
| 5700 | 422 | 489 | 5700 | 432.6 | 492.8 | +10.6 | +3.8 |
| 5800 | 418.7 | 494 | 5800 | 429.1 | 497.7 | +10.4 | +3.7 |
| 5900 | 413.9 | 496.8 | 5900 | 426 | 502.6 | +12.1 | +5.8 |
| 6000 | 409.8 | 501 | 6000 | 421.2 | 505.6 | +11.4 | +4.6 |
| 6100 | 404.3 | 502 | 6100 | 416.7 | 508.6 | +12.4 | +6.6 |
| 6200 | 399.3 | 504 | 6200 | 411 | 510.1 | +11.7 | +6.1 |
| 6300 | 394.6 | 507 | 6300 | 405.1 | 511 | +10.5 | +4 |
| 6400 | 388.2 | 507 | 6400 | 399.1 | 511.7 | +10.9 | +4.7 |
| 6500 | 381.1 | 505 | 6500 | 392.7 | 511.4 | +11.6 | +6.4 |

Table 2 shows dynamometer tests carried out using a NASCAR-approved, NCATS Series Restricted 1⅛" engine with 10:1 compression. Timing was set at 30. The carburetor used was a Holly 390 with 64/64 jets. Oil used was 15/40 viscosity. Fuel octane: 94. Load factor was set at 1.21. The left columns show developed torque and HP at RPM values between 4500 and 6500 using a set of new, standard Autolite AR473 plugs. The middle columns show the same data set for the same plugs, modified with the inventive cap portion. The right columns shown the torque and horsepower gains, which manifest all at all measured speeds.

TABLE 3

| Autolite AR3932X | | | modified AR3932X | | | Gains | |
|---|---|---|---|---|---|---|---|
| RPM | Torque. Lb/FT | HP | RPM | Torque. Lb/FT | HP | Gain In Torque Lb/FT | Gain In HP |
| 4500 | 667.0 | 572.0 | 4500 | 667.0 | 572.0 | +0.0 | +0.0 |
| 4600 | 671.0 | 587.0 | 4600 | 671.0 | 588.0 | +0.0 | +1.0 |
| 4700 | 673.0 | 603.0 | 4700 | 677.0 | 605.0 | +4.0 | +2.0 |
| 4800 | 676.0 | 618.0 | 4800 | 682.0 | 623.0 | +6.0 | +5.0 |
| 4900 | 678.0 | 632.0 | 4900 | 684.0 | 638.0 | +6.0 | +6.0 |
| 5000 | 678.0 | 645.0 | 5000 | 686.0 | 653.0 | +8.0 | +8.0 |
| 5100 | 679.0 | 660.0 | 5100 | 686.0 | 666.0 | +7.0 | +6.0 |
| 5200 | 682.0 | 675.0 | 5200 | 686.0 | 679.0 | +4.0 | +4.0 |
| 5300 | 685.0 | 691.0 | 5300 | 689.0 | 695.0 | +4.0 | +4.0 |
| 5400 | 688.0 | 708.0 | 5400 | 691.0 | 711.0 | +3.0 | +3.0 |
| 5500 | 691.0 | 724.0 | 5500 | 692.0 | 724.0 | −1.0 | +0.0 |
| 5600 | 694.0 | 740.0 | 5600 | 693.0 | 739.0 | −1.0 | −1.0 |
| 5700 | 695.0 | 754.0 | 5700 | 694.0 | 753.0 | −1.0 | −1.0 |
| 5800 | 694.0 | 766.0 | 5800 | 695.0 | 768.0 | +1.0 | +2.0 |
| 5900 | 690.0 | 775.0 | 5900 | 695.0 | 781.0 | +5.0 | +6.0 |
| 6000 | 688.0 | 786.0 | 6000 | 692.0 | 791.0 | +4.0 | +5.0 |
| 6100 | 684.0 | 795.0 | 6100 | 688.0 | 799.0 | +4.0 | +4.0 |
| 6200 | 682.0 | 805.0 | 6200 | 685.0 | 809.0 | +4.0 | +5.0 |
| 6300 | 678.0 | 813.0 | 6300 | 681.0 | 817.0 | +3.0 | +4.0 |
| 6400 | 671.0 | 818.0 | 6400 | 677.0 | 825.0 | +6.0 | +7.0 |
| 6500 | 663.0 | 821.0 | 6500 | 670.0 | 830.0 | +7.0 | +9.0 |
| 6600 | 654.0 | 822.0 | 6600 | 663.0 | 833.0 | +9.0 | +9.0 |
| 6700 | 644.0 | 822.0 | 6700 | 653.0 | 834.0 | +9.0 | +12.0 |
| 6800 | 636.0 | 824.0 | 6800 | 646.0 | 837.0 | +10.0 | +13.0 |
| 6900 | 626.0 | 822.0 | 6900 | 636.0 | 835.0 | +10.0 | +12.0 |
| 7000 | 615.0 | 820.0 | 7000 | 626.0 | 834.0 | +11.0 | +14.0 |

Table 3 shows dynamometer tests carried out using a Chevy Big Block at 12:1 Compression. Timing was set at 32. The carburetor used was a Holly 850 with 77 jets. Oil used was 15/40 viscosity. Fuel octane: 110. Load factor was set at 0.77. The left columns show developed torque and HP at RPM values between 4500 and 7000 using a set of new, standard Autolite AR3932X plugs. The middle columns show the same data set for the same plugs, modified with the inventive cap portion. The right columns shown the torque and horsepower gains, which manifest at all but 5500-5700 RPM.

TABLE 4

| Autolite AR3932X | | | modified AR3932X (.045 gap) | | | Gains | |
|---|---|---|---|---|---|---|---|
| RPM | Torque. Lb/FT | HP | RPM | Torque. Lb/FT | HP | Gain In Torque Lb/FT | Gain In HP |
| 4500 | 667.0 | 572.0 | 4500 | 668.0 | 572.0 | +1.0 | +0.0 |
| 4600 | 671.0 | 587.0 | 4600 | 672.0 | 588.0 | +1.0 | +1.0 |
| 4700 | 673.0 | 603.0 | 4700 | 678.0 | 607.0 | +5.0 | +4.0 |
| 4800 | 676.0 | 618.0 | 4800 | 681.0 | 623.0 | +5.0 | +5.0 |
| 4900 | 678.0 | 632.0 | 4900 | 681.0 | 635.0 | +3.0 | +3.0 |
| 5000 | 678.0 | 645.0 | 5000 | 680.0 | 647.0 | +2.0 | +2.0 |
| 5100 | 679.0 | 660.0 | 5100 | 679.0 | 659.0 | +0.0 | −1.0 |
| 5200 | 682.0 | 675.0 | 5200 | 680.0 | 673.0 | −2.0 | −2.0 |
| 5300 | 685.0 | 691.0 | 5300 | 688.0 | 694.0 | +3.0 | +3.0 |
| 5400 | 688.0 | 708.0 | 5400 | 689.0 | 708.0 | +1.0 | +0 |
| 5500 | 691.0 | 724.0 | 5500 | 690.0 | 723.0 | −1.0 | +1.0 |
| 5600 | 694.0 | 740.0 | 5600 | 693.0 | 739.0 | −1.0 | −1.0 |
| 5700 | 695.0 | 754.0 | 5700 | 695.0 | 754.0 | +0.0 | +0 |
| 5800 | 694.0 | 766.0 | 5800 | 693.0 | 765.0 | −1.0 | −1.0 |
| 5900 | 690.0 | 775.0 | 5900 | 692.0 | 778.0 | +2.0 | +3.0 |
| 6000 | 688.0 | 786.0 | 6000 | 692.0 | 790.0 | +4.0 | +4.0 |
| 6100 | 684.0 | 795.0 | 6100 | 690.0 | 801.0 | +6.0 | +6.0 |
| 6200 | 682.0 | 805.0 | 6200 | 686.0 | 810.0 | +4.0 | +5.0 |
| 6300 | 678.0 | 813.0 | 6300 | 681.0 | 816.0 | +3.0 | +3.0 |
| 6400 | 671.0 | 818.0 | 6400 | 677.0 | 825.0 | +6.0 | +7.0 |
| 6500 | 663.0 | 821.0 | 6500 | 670.0 | 829.0 | +7.0 | +8.0 |

TABLE 4-continued

| Autolite AR3932X | | | modified AR3932X (.045 gap) | | | Gains | |
|---|---|---|---|---|---|---|---|
| RPM | Torque. Lb/FT | HP | RPM | Torque. Lb/FT | HP | Gain In Torque Lb/FT | Gain In HP |
| 6600 | 654.0 | 822.0 | 6600 | 661.0 | 831.0 | +7.0 | +9.0 |
| 6700 | 644.0 | 822.0 | 6700 | 653.0 | 833.0 | +9.0 | +11.0 |
| 6800 | 636.0 | 824.0 | 6800 | 644.0 | 834.0 | +8.0 | +10.0 |
| 6900 | 626.0 | 822.0 | 6900 | 635.0 | 834.0 | +9.0 | +12.0 |
| 7000 | 615.0 | 820.0 | 7000 | 627.0 | 836.0 | +12.0 | +16.0 |

Table 4 shows dynamometer tests carried out using a Chevy Big Block at 12:1 Compression, 0.045 gap. Timing was set at 32. The carburetor used was a Holly 850 with 77 jets. Oil used was 15/40 viscosity. Fuel octane: 110. Load factor was set at 0.77. The left columns show developed torque and HP at RPM values between 4500 and 7000 using a set of new, standard Autolite AR3932X plugs. The middle columns show the same data set for the same plugs, modified with the inventive cap portion. The right columns shown the torque and horsepower gains, which manifest at all but 5500-5800 RPM.

TABLE 5

| HORSE POWER COMPARISON | | | | | | | | |
|---|---|---|---|---|---|---|---|---|
| OE AR3932X | | | | | | NS AR3932X | | |
| #1 HP OE | #2 HP OE | #3 HP OE | Average OE HP | RPM | Average NS HP | #1 HP NS | #2 HP NS | #3 HP NS |
| 572 | 569 | 571 | 570.6 | 4500 | 572 | 571 | 572 | 573 |
| 587 | 583 | 587 | 585.6 | 4600 | 587.6 | 588 | 588 | 587 |
| 603 | 599 | 604 | 602 | 4700 | 604.3 | 605 | 605 | 603 |
| 618 | 615 | 621 | 618 | 4800 | 621.3 | 622 | 623 | 619 |
| 632 | 629 | 636 | 632.3 | 4900 | 636.3 | 637 | 638 | 634 |
| 645 | 642 | 650 | 645.6 | 5000 | 650.3 | 651 | 653 | 647 |
| 660 | 655 | 662 | 659 | 5100 | 664.3 | 665 | 666 | 662 |
| 675 | 671 | 676 | 674 | 5200 | 678.6 | 680 | 679 | 677 |
| 691 | 689 | 692 | 690.6 | 5300 | 693.6 | 692 | 695 | 694 |
| 708 | 706 | 707 | 707 | 5400 | 709.6 | 708 | 711 | 710 |
| 724 | 723 | 724 | 723.6 | 5500 | 724.3 | 723 | 724 | 726 |
| 740 | 740 | 741 | 740.3 | 5600 | 740 | 739 | 739 | 742 |
| 754 | 754 | 755 | 754.3 | 5700 | 755 | 754 | 753 | 758 |
| 766 | 764 | 768 | 766 | 5800 | 767.6 | 765 | 768 | 770 |
| 775 | 774 | 778 | 775.6 | 5900 | 780.3 | 778 | 781 | 782 |
| 786 | 783 | 789 | 786 | 6000 | 791.6 | 790 | 791 | 794 |
| 795 | 794 | 797 | 795.3 | 6100 | 801.6 | 801 | 799 | 805 |
| 805 | 806 | 806 | 805.6 | 6200 | 811.6 | 810 | 809 | 816 |
| 813 | 814 | 813 | 813.3 | 6300 | 818.6 | 816 | 817 | 823 |
| 818 | 819 | 819 | 818.6 | 6400 | 826 | 825 | 825 | 828 |
| 821 | 823 | 825 | 823 | 6500 | 830.6 | 829 | 830 | 833 |
| 822 | 826 | 828 | 825.3 | 6600 | 833 | 831 | 833 | 835 |
| 822 | 828 | 830 | 826.6 | 6700 | 834.3 | 833 | 834 | 836 |
| 824 | 827 | 828 | 826.3 | 6800 | 836 | 834 | 837 | 837 |
| 822 | 826 | 824 | 824 | 6900 | 835 | 834 | 835 | 836 |
| 820 | 825 | 822 | 822.3 | 7000 | 835.3 | 836 | 834 | 836 |

TABLE 6

| TORQUE COMPARISON | | | | | | | | |
|---|---|---|---|---|---|---|---|---|
| OE AR3932X | | | | | | NS AR473 | | |
| #1 TQ OE | #2 TQ OE | #3 TQ OE | Average OE TQ | RPM | Average NS TQ | #1 TQ NS | #2 TQ NS | #3 TQ NS |
| 667 | 664 | 666 | 665.6 | 4500 | 667.3 | 667 | 667 | 668 |
| 671 | 666 | 671 | 669.3 | 4600 | 671 | 672 | 671 | 670 |

TABLE 6-continued

| TORQUE COMPARISON | | | | | | | | |
|---|---|---|---|---|---|---|---|---|
| OE AR3932X | | | | | | NS AR473 | | |
| #1 TQ OE | #2 TQ OE | #3 TQ OE | Average OE TQ | RPM | Average NS TQ | #1 TQ NS | #2 TQ NS | #3 TQ NS |
| 673 | 669 | 675 | 672.3 | 4700 | 676.3 | 676 | 677 | 676 |
| 676 | 673 | 680 | 676.3 | 4800 | 680.3 | 681 | 682 | 678 |
| 678 | 674 | 682 | 678 | 4900 | 683.6 | 683 | 684 | 684 |
| 678 | 674 | 683 | 678.3 | 5000 | 686 | 684 | 686 | 688 |
| 679 | 675 | 682 | 678.6 | 5100 | 685 | 685 | 686 | 684 |
| 682 | 678 | 683 | 681 | 5200 | 685.6 | 687 | 686 | 684 |
| 685 | 682 | 685 | 684 | 5300 | 688.3 | 688 | 689 | 688 |
| 688 | 687 | 688 | 687.6 | 5400 | 690 | 689 | 691 | 690 |
| 691 | 690 | 691 | 690.6 | 5500 | 691.6 | 690 | 692 | 693 |
| 694 | 694 | 695 | 694.3 | 5600 | 694 | 693 | 693 | 696 |
| 695 | 695 | 696 | 695.3 | 5700 | 695.6 | 695 | 694 | 698 |
| 694 | 692 | 695 | 693.6 | 5800 | 695 | 693 | 695 | 697 |
| 690 | 689 | 692 | 690.3 | 5900 | 694.3 | 692 | 695 | 696 |
| 688 | 686 | 690 | 688 | 6000 | 693 | 692 | 692 | 695 |
| 684 | 684 | 687 | 685 | 6100 | 690.3 | 690 | 688 | 693 |
| 682 | 683 | 683 | 682.6 | 6200 | 687.3 | 686 | 685 | 691 |
| 678 | 678 | 678 | 678 | 6300 | 682.6 | 681 | 681 | 686 |
| 671 | 672 | 672 | 671.6 | 6400 | 677.6 | 677 | 677 | 679 |
| 663 | 665 | 666 | 664.6 | 6500 | 671 | 670 | 670 | 673 |
| 654 | 657 | 659 | 656.6 | 6600 | 663 | 661 | 663 | 665 |
| 644 | 649 | 651 | 648 | 6700 | 653.6 | 653 | 653 | 655 |
| 636 | 639 | 640 | 638.3 | 6800 | 645.6 | 644 | 646 | 647 |
| 626 | 629 | 628 | 627.6 | 6900 | 635.6 | 635 | 636 | 636 |
| 615 | 619 | 617 | 617 | 7000 | 626.6 | 627 | 626 | 627 |

Figure 6:
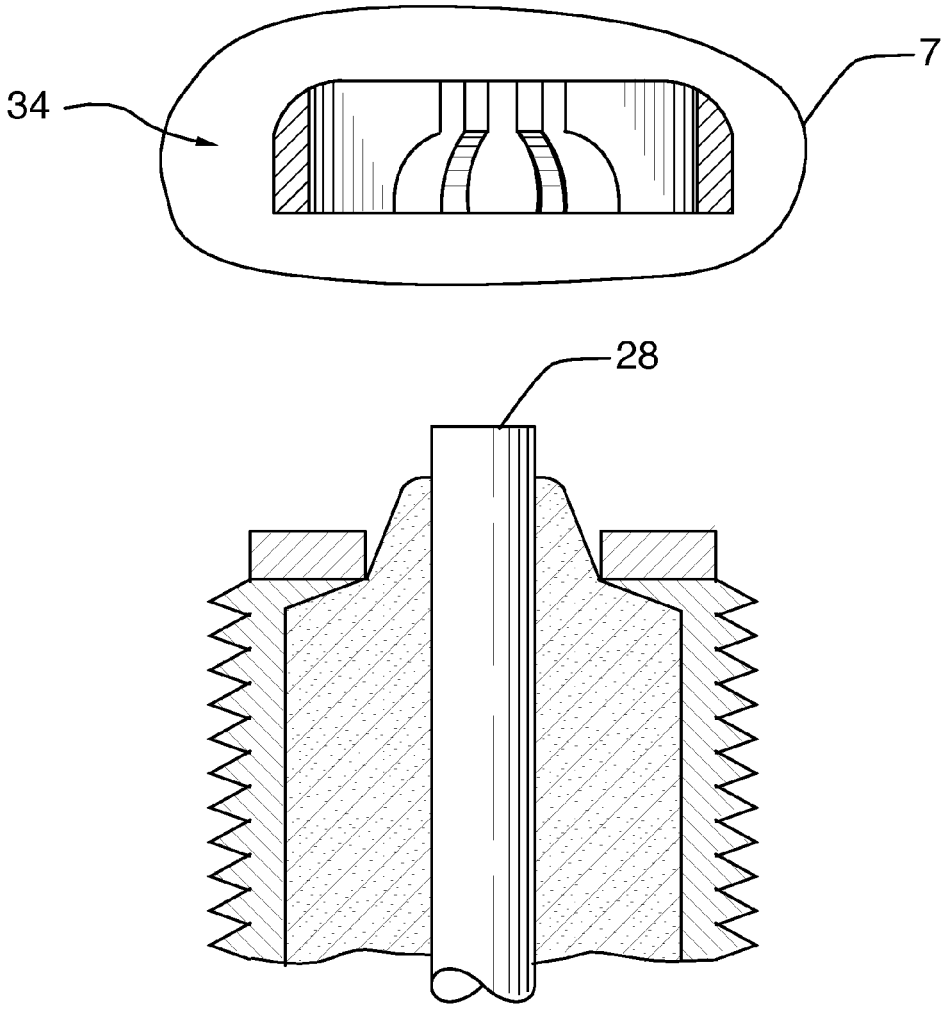
FIG. 6 is a view similar to FIG. 5, illustrative of an exemplary method of manufacture.
Figure 8:
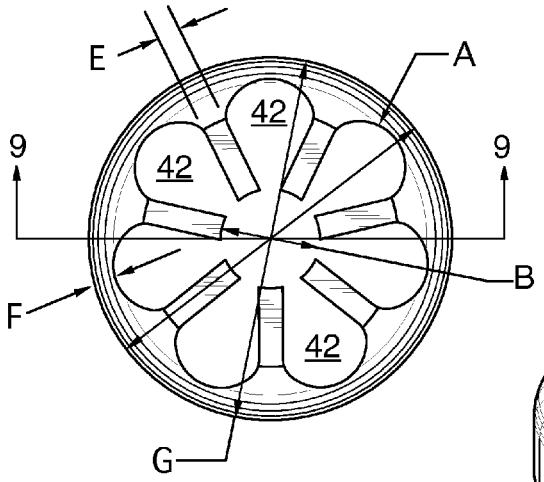
FIG. 8 is a plan view of the structure of FIG. 7.
Figure 7:
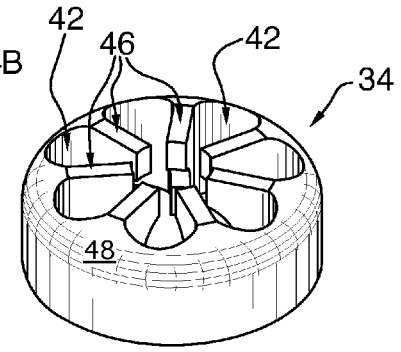
FIG. 7 is a perspective view of encircled area 7 of FIG. 6.
Figure 9:
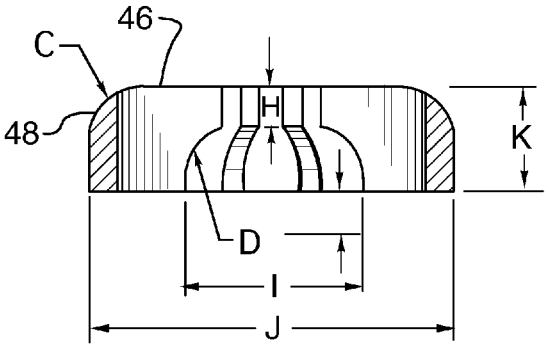
FIG. 9 is a view along 9-9 of FIG. 8.
Figure 10:
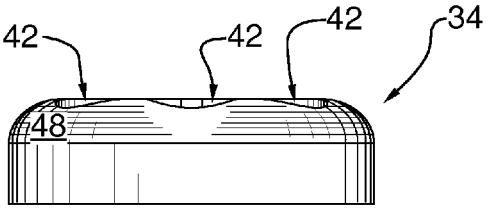
FIG. 10 is a side view of the structure of FIG. 7.

Tables 5 and 6 show dynamometer tests for a Chevy Big Block. Timing was set at 32. The carburetor used was a Holly 850 with 77/77 jets. Oil used was 15/40 viscosity. Fuel octane: 110. Load factor was set at 0.77. In Table 5, the three left columns show developed horsepower at RPM between 4500 and 7000 using a set of new AR3932X plugs. The three right columns show the same data for the same plugs, modified with the inventive cap portion. Horsepower gains were obtained at all speeds but for 5600 RPM. In Table 6, the three left columns show developed torque at RPM between 4500 and 7000 using a set of new AR3932X plugs. The three right columns show the same data for the same plugs, modified with the inventive cap portion. Torque gains were obtained at all speeds but for 5600 RPM In each of the examples, reference is made to plugs that have been modified with the inventive cap portion. In this regard, it will be appreciated that, in each case, the reference/baseline plug mentioned was modified by grinding off the electrode leg thereof and welding a ring thereto, as illustrated by FIG. 6.

An exemplary ring is shown in FIGS. 7-10. This ring is produced from 304 2B stainless steel and is dimensioned as follows:

| | |
|---|---|
| A | .060 radius |
| B | .13" |
| C | .07" radius |
| D | .076R |
| E | .031" |
| F | .028" |
| G | .47" |
| H | .05" |
| I | .24" |
| J | .47" |
| K | .13" |

However, it will be understood that these dimensions were selected such that the distance between the positive electrode and the ring is the distance specified by the manufacturer of the vehicle with which the modified plug was used. Variation from these dimensions are possible and indeed would be adopted in other engine applications to meet the specifications of the engine manufacturer.

Further, whereas a seven lobe structure is disclosed, the plurality of lobes can consist of three to seven lobes.

Accordingly, it should be understood that the invention is to be limited only by the accompanying claims, purposively construed.

The invention claimed is:

1. A spark plug for use with an engine block/cylinder head having a threaded bore and also for use with a spark plug wrench and an ignition wire, the plug comprising:

a nut portion adapted to be turned by the wrench;

a coupling portion extending from the nut portion and adapted to receive the ignition wire;

an insulator portion extending from the nut portion and away from the coupling portion to an end;

a positive electrode extending through and beyond the end of the insulator portion; and a ground electrode including a tubular metal portion extending from the nut portion in surrounding relation to the insulator portion, the tubular portion being orientated coaxially about and defining a longitudinal axis and further being externally-threaded for engagement in the threaded bore in said engine block in use; and a cap portion to which the metal portion extends and disposed in spaced relation to the insulator portion, the cap portion defining a void having:

a central portion into which the positive electrode extends; and an annular channel surrounding the central portion; and a plurality of lobes, each being positioned with respect to the central portion in a manner analogous to the placement of the planet gears with respect to the sun gear in a planetary gear; and having:

a central surface axially spaced from that portion of the insulator that protrudes beyond the tubular portion; and a convex surface that surrounds and extends to the central surface.

2. The spark plug according to claim 1, wherein the central surface is orientated substantially normally to the longitudinal axis and substantially coplanar with the end of the positive electrode.

3. A spark plug according to claim 1, wherein the plurality of lobes consists of three to seven lobes.

4. A spark plug according to claim 3, wherein if

R1 is the radius of each planet gear

R2 is the distance from the axis of each planet gear to the axis of the sun gear R3 is the outer radius of the ground electrode R4 is the outer radius of the annular channel R1:R2:R3:R4:R5 is about 0.12:0.305:0.475:0.25.

5. A spark plug according to claim 4, wherein the plurality of lobes consists of seven lobes.

* * * * *